US008584627B2

(12) United States Patent
Poeschl et al.

(10) Patent No.: US 8,584,627 B2
(45) Date of Patent: Nov. 19, 2013

(54) LIQUID-COOLED INTERNAL COMBUSTION

(75) Inventors: Robert Poeschl, Graz-Andritz (AT); Andreas Ennemoser, Graz (AT); Manfred Breitenberger, Graz (AT)

(73) Assignee: AVL List GmbH, Graz (AT)

( * ) Notice: Subject to any disclaimer, the term of this patent is extended or adjusted under 35 U.S.C. 154(b) by 649 days.

(21) Appl. No.: 12/594,405

(22) PCT Filed: Apr. 1, 2008

(86) PCT No.: PCT/EP2008/053866
§ 371 (c)(1),
(2), (4) Date: Jan. 14, 2010

(87) PCT Pub. No.: WO2008/122544
PCT Pub. Date: Oct. 16, 2008

(65) Prior Publication Data

US 2010/0132639 A1 Jun. 3, 2010

(30) Foreign Application Priority Data

Apr. 5, 2007 (AT) ..... A 537/2007

(51) Int. Cl.
*F02F 1/36* (2006.01)

(52) U.S. Cl.
USPC ..... 123/41.82 R; 123/41.74; 123/41.79

(58) Field of Classification Search
USPC ..... 123/41.32, 41.74, 41.82 R, 41.72, 41.31, 123/41.77, 41.85, 41.28, 41.44, 193.1, 123/193.5, 41.29
See application file for complete search history.

(56) References Cited

U.S. PATENT DOCUMENTS 884,326 A * 4/1908 Emery ..... 123/41.28
3,165,095 A * 1/1965 Adler ..... 123/41.82 R (Continued)

FOREIGN PATENT DOCUMENTS

AT 005939 1/2003
FR 2855555 12/2004

(Continued)

OTHER PUBLICATIONS

English Abstract of JP 8218873.

(Continued)

*Primary Examiner* — Noah Kamen
(74) *Attorney, Agent, or Firm* — Dykema Gossett PLLC

(57) ABSTRACT

A liquid-cooled internal combustion engine which includes a cylinder housing for at least one cylinder and at least one cylinder head, with the at least one cylinder in the cylinder housing being enclosed by a cooling jacket and with a bottom partial cooling chamber adjacent to a fire deck and an upper partial cooling chamber which is flow-connected with the same via at least one transfer opening being arranged in the cylinder head which is connected with the cylinder housing, with a coolant outlet which can be connected with a pressure sink originating from the bottom partial cooling chamber. In order to improve cooling, at least one coolant inlet which can be connected with a pressure source opens into the cooling jacket of the cylinder housing and the cooling jacket is flow-connected directly with the upper partial cooling chamber via at least one riser manifold, so that coolant flows in engine operation from the pressure source to the cooling jacket of the cylinder housing and from there to the upper partial cooling chamber of the cylinder head and further via the transfer opening into the bottom partial cooling chamber and from there to the pressure sink.

9 Claims, 1 Drawing Sheet

(56) References Cited

U.S. PATENT DOCUMENTS

| | | | | |
|---|---|---|---|---|
| 7,021,250 | B2 * | 4/2006 | Marinica et al. | 123/41.72 |
| 7,240,644 | B1 * | 7/2007 | Slike et al. | 123/41.82 R |
| 7,430,994 | B2 * | 10/2008 | Petutsching et al. | 123/41.82 R |
| 2006/0196453 | A1 * | 9/2006 | Yamada et al. | 123/41.32 |

FOREIGN PATENT DOCUMENTS

| | | | |
|---|---|---|---|
| JP | 08218873 | | 8/1996 |
| JP | 2003201842 | | 7/2003 |
| JP | 2007051601 | A * | 3/2007 |

* cited by examiner

LIQUID-COOLED INTERNAL COMBUSTION

BACKGROUND OF THE INVENTION

1. Field of the Invention

The invention relates to a liquid-cooled internal combustion engine, which includes a cylinder housing for at least one cylinder and at least one cylinder head, with the at least one cylinder in the cylinder housing being enclosed by a cooling jacket and with a bottom partial cooling chamber adjacent to a fire deck and an upper partial cooling chamber which is flow-connected with the same via at least one transfer opening arranged in the cylinder head which is connected with the cylinder housing, with a coolant outlet which can be connected with a pressure sink originating from the bottom partial cooling chamber.

2. The Prior Art

A cylinder head is known from AT 005.939 U1 for a liquid-cooled internal combustion engine with a cooling chamber arrangement adjacent to a fire deck, which arrangement is subdivided by an intermediate deck arranged substantially parallel to the fire deck in a bottom partial cooling chamber on the fire deck side and an upper partial cooling chamber adjacent to the same in the direction of the cylinder axis. The bottom and upper partial cooling chamber are flow-connected with each other by at least one transfer opening. A coolant inlet which can be connected with a pressure source opens into the upper partial cooling chamber. A coolant outlet which can be connected with a pressure sink originates from the bottom partial cooling chamber. As a result, the coolant flows in engine operation into the upper partial cooling chamber coming from the pressure source and from there via the transfer opening into the bottom partial cooling chamber and from there to the pressure sink. The coolant further flows from the bottom partial cooling chamber via connecting openings in the fire deck into the cooling jacket of the cylinder housing. The disadvantage is that the region of the liners is not sufficiently cooled. A further disadvantage is that the flow direction from the upper partial cooling chamber via the bottom partial cooling chamber into the cooling jacket of the cylinder housing occurs against the thermosyphon effect in the entire cooling system, which disadvantageously influences the passage of the coolant especially in emergency operation.

It is the object of the invention to avoid such disadvantages and, by using the physical thermosyphon effect, to achieve an improved cooling of thermally critical areas, especially the bottom partial cooling chamber of the cylinder head and the liners.

SUMMARY OF THE INVENTION

This is achieved in accordance with the invention in such a way that at least one coolant inlet which can be connected with a pressure source opens into the cooling jacket of the cylinder housing and that the cooling jacket is flow-connected directly with the upper partial cooling chamber via at least one riser manifold, so that coolant flows in engine operation from the pressure source to the cooling jacket of the cylinder housing and from there to the upper partial cooling chamber of the cylinder head and further via the transfer opening into the bottom partial cooling chamber and from there to the pressure sink. It is provided that the coolant is introduced into the cooling jacket of the cylinder housing coming from a pressure source and is supplied from there directly to the upper partial cooling chamber, and that the coolant is supplied from the upper partial cooling chamber via at least one transfer opening per cylinder into the bottom partial cooling chamber and further from the bottom partial cooling chamber to a pressure sink outside of the internal combustion engine, with the coolant flowing through the cooling chamber, the upper partial cooling chamber and the bottom partial cooling chamber per cylinder substantially in the transversal direction of the engine.

It is especially advantageous when a coolant distribution chamber is arranged on a longitudinal side of the cylinder housing, with preferably the cooling jacket being flow-connected via at least one coolant inlet per cylinder with the distribution chamber. In order to achieve an even inflow of the coolant into the upper partial cooling chamber it is provided that the cylinder head comprises riser manifolds on both longitudinal sides for producing the flow connection of the coolant jacket with the upper partial cooling chamber, with at least two riser manifolds which are arranged on opposite longitudinal sides being preferably arranged per cylinder.

It can be provided in a further development of the invention that the cooling jacket is directly connected with the bottom partial cooling chamber via bypass openings with a defined flow cross section, with the bypass openings being formed by flow transfers in the cylinder head gasket. In this way, any vapor bubbles that might arise in the cooling jacket can be diverted directly to the bottom partial cooling chamber of the cylinder head. Moreover, a purposeful cooling of thermally critical areas such as in the area of the exhaust valve cross-pieces can be achieved by the bypass openings.

A distinctive cross-flow of the coolant is achieved when a bottom partial cooling chamber is provided for each cylinder, with the bottom partial cooling chambers of two adjacent cylinders being separated from each. Each bottom partial cooling chamber can be connected via at least one coolant outlet with a coolant collector arranged on one longitudinal side of the cylinder head. The upper partial cooling chamber can be arranged continuously for several cylinders in the longitudinal direction.

In order to avoid the accumulation of vapor in the upper partial cooling chamber it is advantageous when the upper partial cooling chamber is flow-connected with the coolant collecting chamber via at least one devaporization opening with a small cross section. As an alternative it is also possible to connect the upper partial cooling chamber via a devaporization opening with a compensating tank of the cooling system.

The invention will now be explained in greater detail by reference to the attached drawings.

DETAILED DESCRIPTION OF THE PREFERRED EMBODIMENT

Figure 1:
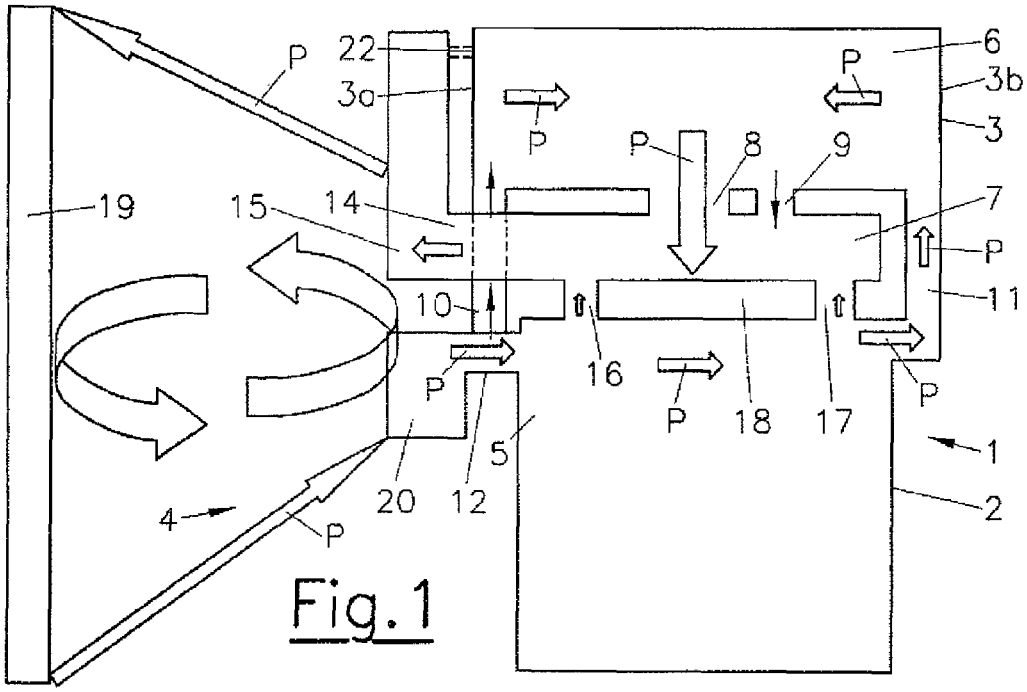
FIG. 1 schematically shows a cooling system for an internal combustion engine in accordance with the invention.
Figure 2:
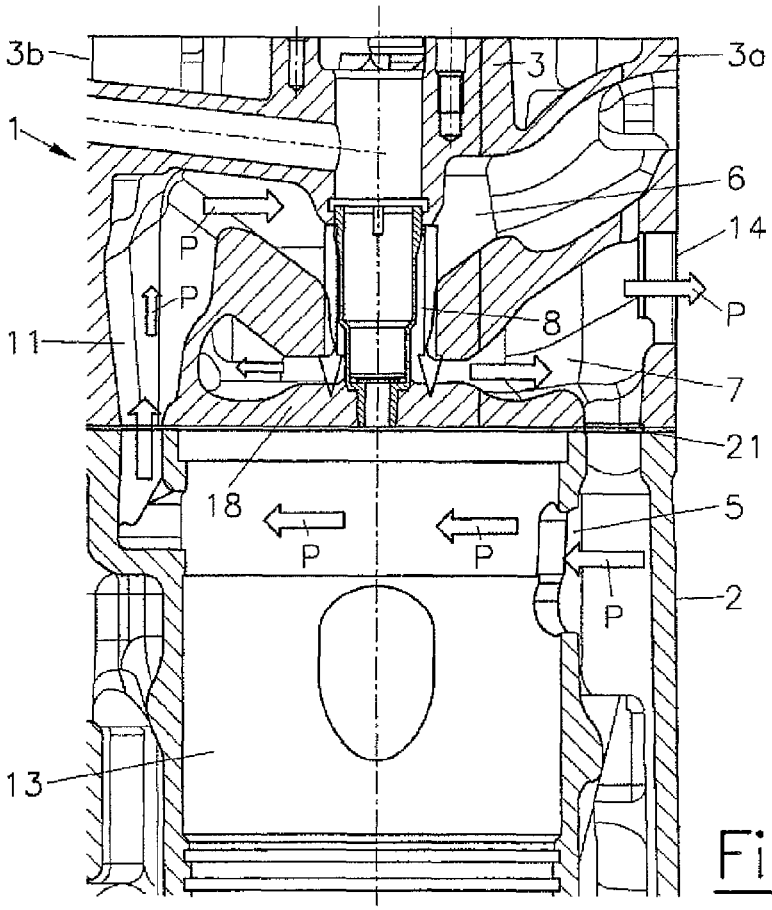
FIG. 2 shows the internal combustion engine in a cross-sectional view.

Internal combustion engine 1 comprises a cylinder housing 2 and a cylinder head 3. A cooling system 4 is provided for cooling with a cooling fluid which flows through a cooling jacket 5 in the cylinder housing 2 and upper and bottom partial cooling chambers 6, 7 in the cylinder head 3. The upper partial cooling chamber 6 and the bottom partial cooling chamber 7 are flow connected via at least one transfer opening 8, 9 per cylinder. Riser manifolds 10, 11 are arranged on opposite longitudinal sides 3*a*, 3*b* of the cylinder head 3, which manifolds connect the upper partial cooling chamber 6 with the cooling jacket 5 of the cylinder housing 2. The cooling jacket 5 of the cylinder housing 2 is connected via at least one coolant inlet 12 per cylinder 13 with a coolant distribution chamber 20 extending over a longitudinal side 3*a*. The bottom partial cooling chamber 7 opens via at least one coolant outlet 14 per cylinder 13 into a coolant collecting chamber 15 arranged on the longitudinal side 3*a* of the cylinder head 3. Furthermore, bypass openings 16, 17 can be arranged in the fire deck 18 which connect the cooling jacket 5 directly with the bottom partial cooling chamber 7. The bypass openings 16, 17 have a precisely defined transfer cross section which is formed by flow transfers in the cylinder head gasket 21, so that only a relatively small quantity of coolant can transfer directly into the bottom partial cooling chamber 7.

In order to prevent the accumulation of vapor in the upper partial cooling chamber 6, a devaporization opening 22 of small cross section can be used to connect the upper partial cooling chamber 6 with the coolant collecting chamber 15 on at least one cylinder.

The coolant flows according to the arrows P from a coolant pump (not shown in greater detail) into the coolant distribution chamber 20 and reaches the coolant jacket 5 mostly over coolant inlets 12 around the liners of the cylinders 13 or via the riser manifold 10 directly into the upper partial cooling chamber. The cylinder housing 2 is flowed through by coolant in the transversal direction. The coolant further reaches the upper partial cooling chamber 6 via the riser manifolds 10, 11, with the percentage of coolant quantity through the coolant jacket 5 being set by the geometrical configuration of the riser manifolds 10, 11 and the respective gasket openings. The entire coolant is guided via transfer openings 8, 9 to the bottom partial cooling chamber 7. The bottom partial cooling chamber 7 is flowed through substantially in the radial direction transversally to the engine, like the upper partial cooling chamber 6, with the coolant reaching the coolant collecting chamber 15 via the coolant outlets 14 on the longitudinal side 3*a* of the cylinder head 3. The coolant is supplied to a fluid cooler 19 from the coolant collecting chamber 15 and finally via the coolant pump back to the coolant distributor chamber 20.

The invention was described on the basis of an internal combustion engine with several cylinders and a continuous cylinder head. It can also be applied to single-cylinder engines.

The invention claimed is:

1. A liquid-cooled internal combustion engine, comprising a cylinder housing for at least one cylinder and at least one cylinder head connected to the cylinder housing, with the at least one cylinder in the cylinder housing being enclosed by a cooling jacket, the cylinder head comprising a bottom partial cooling chamber adjacent to a fire deck and an upper partial cooling chamber which is flow-connected with the bottom partial cooling chamber via at least one transfer opening being arranged in the cylinder head, with a coolant outlet which can be connected with a pressure sink originating from the bottom partial cooling chamber, wherein at least one coolant inlet which can be connected with a pressure source opens into the cooling jacket of the cylinder housing and wherein the cooling jacket is flow-connected directly with the upper partial cooling chamber via at least one riser manifold, so that coolant flows in engine operation from the pressure source to the cooling jacket of the cylinder housing and from there to the upper partial cooling chamber of the cylinder head and further via the transfer opening into the bottom partial cooling chamber and from there to the pressure sink, wherein the cooling jacket is directly connected with the bottom partial cooling chamber via bypass openings having a defined flow cross-section, with the bypass openings being formed by flow transfers in a cylinder head gasket.

2. The internal combustion engine according to claim 1, wherein a coolant distribution chamber is arranged on a longitudinal side of the cylinder housing.

3. The internal combustion engine according to claim 1, wherein the cooling jacket is flow-connected with the distribution chamber via at least one coolant inlet per cylinder.

4. The internal combustion engine according to claim 1, wherein the cylinder head comprises riser manifolds on both longitudinal sides for producing the flow connection of the coolant jacket with the upper partial cooling chamber.

5. The internal combustion engine according to claim 4, wherein at least two riser manifolds which are arranged on opposite longitudinal sides are arranged per cylinder.

6. The internal combustion engine according to claim 1, wherein a bottom partial cooling chamber is provided for each cylinder, with the bottom partial cooling chambers of two adjacent cylinders being separated from each other.

7. The internal combustion engine according to claim 6, wherein each bottom partial cooling chamber can be connected via at least one coolant outlet with a coolant collector arranged on one longitudinal side of the cylinder head.

8. The internal combustion engine according to claim 1, wherein the upper partial cooling chamber is arranged continuously for several cylinders.

9. The internal combustion engine according to claim 1, wherein the upper partial cooling chamber is flow-connected with the coolant collecting chamber via at least one devaporization opening.

* * * * *

UNITED STATES PATENT AND TRADEMARK OFFICE

CERTIFICATE OF CORRECTION

PATENT NO. : 8,584,627 B2
APPLICATION NO. : 12/594405
DATED : November 19, 2013
INVENTOR(S) : Poeschl et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 749 days.

Signed and Sealed this
Twenty-second Day of September, 2015

Michelle K. Lee

Michelle K. Lee
*Director of the United States Patent and Trademark Office*